US006073303A

United States Patent [19]

Hinojosa

[11] Patent Number: 6,073,303

[45] Date of Patent: Jun. 13, 2000

[54] DOUBLE ACTION VACUUM CLEANER

[76] Inventor: Jesus P. Hinojosa, 116 Chestnut St., Windsor, Colo. 80550

[21] Appl. No.: 09/126,338

[22] Filed: Jul. 30, 1998

[51] Int. Cl.[7] ..... A47L 9/04

[52] U.S. Cl. ..... 15/385; 15/384; 15/410

[58] Field of Search ..... 15/384, 385, 410

[56] References Cited

U.S. PATENT DOCUMENTS

| | | | |
|---|---|---|---|
| 2,266,075 | 12/1941 | Replogle | 15/384 |
| 2,739,340 | 3/1956 | Blydenburgh et al. | 15/384 |
| 3,150,394 | 9/1964 | Sauers | 15/384 |
| 3,220,043 | 11/1965 | Lampe | 15/384 |
| 3,624,861 | 12/1971 | Freiheit | 15/384 |
| 4,134,673 | 1/1979 | Fisher | 15/256.52 |
| 4,267,617 | 5/1981 | Brown et al. | 15/384 |
| 4,426,751 | 1/1984 | Nordeen | 15/384 |
| 4,850,077 | 7/1989 | Venturini | 15/384 |
| 5,018,240 | 5/1991 | Holman | 15/384 |
| 5,077,863 | 1/1992 | Rench | 15/384 |
| 5,416,948 | 5/1995 | Worwag | 15/331 |

*Primary Examiner*—Theresa T. Snider

[57] ABSTRACT

A double action vacuum cleaner is provided including a frame with a pair of wheels and a pair of brushes rotatably mounted to the frame. A motor assembly is included for rotating the brushes upon the actuation thereof. Also included is a handle portion having a pair of elongated bars each having an inboard end rotatably mounted to the frame and extending upwardly and rearwardly therefrom. Also provided is a vacuum assembly for suctioning dirt loosened by the brushes upon the actuation thereof.

12 Claims, 3 Drawing Sheets

FIG. 3
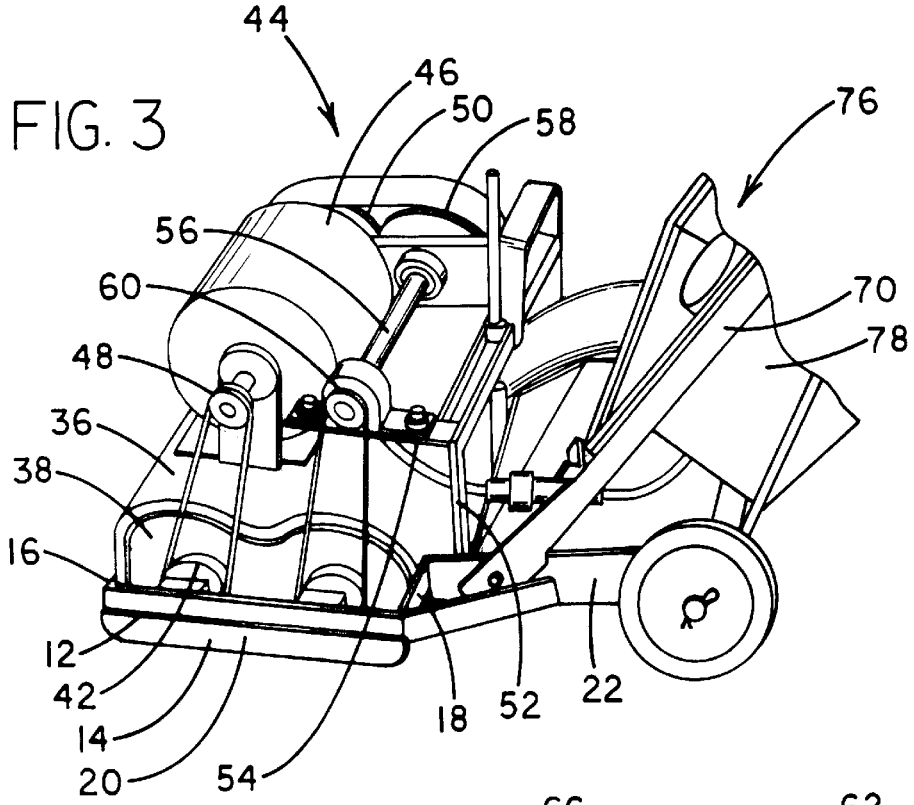
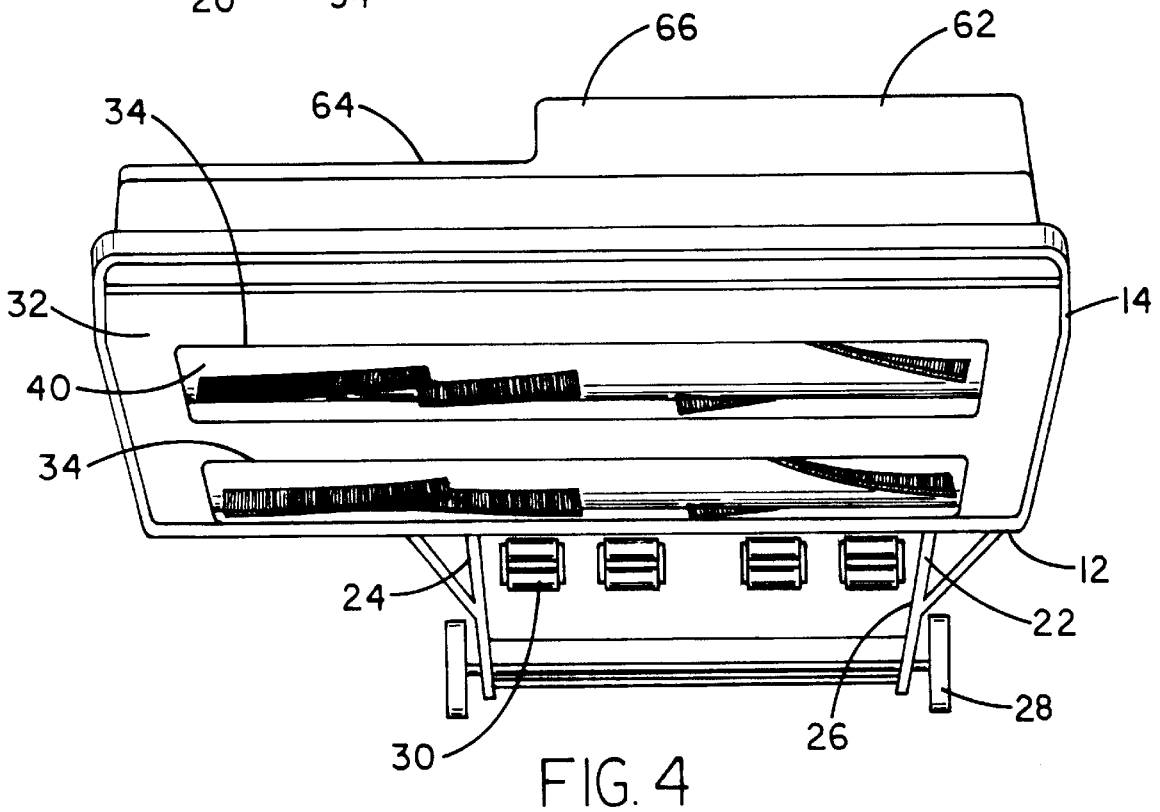
FIG. 4

DOUBLE ACTION VACUUM CLEANER

BACKGROUND OF THE INVENTION

1. Field of the Invention

The present invention relates to vacuum cleaners and more particularly pertains to a new double action vacuum cleaner for removing dirt from a recipient surface in an effective manner.

2. Description of the Prior Art

The use of vacuum cleaners is known in the prior art. More specifically, vacuum cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art vacuum cleaners include U.S. Pat. Nos. 5,077,863; 4,426,751; Des. 358,631; 5,416,948; 4,134,673; and 4,850,077.

In these respects, the double action vacuum cleaner according to the present invention substantially departs from the conventional concepts and designs of the prior art, and in so doing provides an apparatus primarily developed for the purpose of removing dirt from a recipient surface in an effective manner.

SUMMARY OF THE INVENTION

In view of the foregoing disadvantages inherent in the known types of vacuum cleaners now present in the prior art, the present invention provides a new double action vacuum cleaner construction wherein the same can be utilized for removing dirt from a recipient surface in an effective manner.

The general purpose of the present invention, which will be described subsequently in greater detail, is to provide a new double action vacuum cleaner apparatus and method which has many of the advantages of the vacuum cleaners mentioned heretofore and many novel features that result in a new double action vacuum cleaner which is not anticipated, rendered obvious, suggested, or even implied by any of the prior art vacuum cleaners, either alone or in any combination thereof.

To attain this, the present invention generally comprises a frame having a front extent with a rectangular configuration. As shown in FIG. 4, the front extent of the frame is defined by a front bar, a rear bar and a pair of side bars mounted therebetween. The frame further includes a rear extent including a first strip mounted to the rear bar at a central extent thereof. Associated therewith is a second strip mounted to the rear bar adjacent to an end thereof. As shown in FIG. 3, each of the strips of the rear extent extends rearwardly in coplanar relationship with respect to the front extent. The frame of the vacuum cleaner further includes a pair of wheels rotatably coupled to the ends of the strips of the rear extent of the frame. FIG. 4 shows a plurality of dual rollers rotatably mounted along the rear bar of the front extent of the frame between the strips of the rear extent. The rollers preferably extend downwardly from the front extent less than a distance in which the wheels extend. The frame further includes a bottom face mounted to a lower peripheral edge of the front extent of the frame. As shown in FIG. 4, a pair of rectangular cut outs are formed in the bottom face in parallel relationship with respect to each other. The frame further includes a top cover having a front face, a rear face and a single side face defining an open side and an open bottom with a bottom peripheral edge. Such bottom peripheral edge of the top cover is mounted along the bars of the front extent of the frame. See FIG. 3. Next provided is a pair of brushes each including a cylinder with a pulley mounted on an end thereof. Each cylinder also has a plurality of strips of bristles coupled thereto and extending radially therefrom. As shown in FIG. 4, each strip of bristles has a length which is less than ⅓ a length of the cylinder and has an arcuate configuration. The brushes are each rotatably mounted between the side bars of the front extent of the frame with the bristles thereof extending from one of the cut outs of the bottom face of the frame. As shown in FIG. 3, the pulley of each brush is exposed by the open side of the top cover. As best shown in FIG. 3, a motor assembly is provided including a motor mounted on the top cover. A rotor of the motor has a first end extending from a stator of the motor with a pulley residing above that of a front one of the brushes. Such pulley is adapted for engaging the same via a first belt. A second end of the rotor is equipped with a first disk-shaped gear mounted thereon. The motor assembly further includes a pair of vertically oriented stanchions coupled to inboard ends of the strips of the rear extent of the frame and extending upwardly therefrom. A pair of horizontally oriented support members are coupled between top ends of the stanchions and the motor. With reference still to FIG. 3, the motor assembly further includes an auxiliary axle rotatably mounted between the support members. A first end of the auxiliary axle has a second disk-shaped gear mounted thereon for engaging the first disk-shaped gear. A second end of the auxiliary axle has a pulley in communication with that of a rear one of the brushes via a second belt. By this structure, the brushes are rotated in opposite directions upon the actuation of the motor. FIGS. 1 & 2 illustrate a rigid upper covering with a first side extent with a first height and a second side extent with a second height twice the first height. In use, the upper covering is removably mounted over the front extent of the frame with the second side extent thereof covering the motor assembly. The second side extent has a handle mounted thereon for allowing the removal of the upper covering from frame. As shown in FIG. 3, a handle portion includes a pair of elongated bars each having an inboard end rotatably mounted to a central extent of one of the strips of the rear extent of the frame. The elongated bars of the handle portion extend upwardly and rearwardly from the frame. A handle bar is mounted between outboard ends of the elongated bars. Further, a pair of L-shaped brackets are coupled to ends of one of the elongated bars for allowing a power cord to be wrapped thereon. Also included is a vacuum assembly including a casing having a rigid bottom face and a pair of side faces extending from side edges of the bottom face. Such side faces of the casing are coupled along the elongated bars of the handle portion. The casing of the vacuum assembly further includes a removable top face mounted between the elongated bars of the handle portion for defining a closed interior space. FIGS. 3 & 5 shows a flexible vacuum tube of the vacuum assembly with a first end in communication with an interior space defined by the top cover of the frame. A second end of the vacuum tube extends within the interior space of the casing with an inflatable air permeable bag coupled thereto. Mounted to the bottom face of the casing is a pair of vacuum motors each with a filtered inlet situated within the interior space of the vacuum casing. An outlet of each vacuum motor extends through a vent formed in the bottom face of the casing. In operation, the vacuum motors suction air from within the top cover and excrete the same from the vacuum casing upon the actuation thereof. Finally, a plurality of controls are positioned on an upper extent of the top face of the casing of the vacuum assembly. Such controls which preferably take the form of toggle switches are connected between the vacuum motors and the motor of the motor assembly and are adapted for selectively actuating the same in an independent manner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new double action vacuum cleaner apparatus and method which has many of the advantages of the vacuum cleaners mentioned heretofore and many novel features that result in a new double action vacuum cleaner which is not anticipated, rendered obvious, suggested, or even implied by any of the prior art vacuum cleaners, either alone or in any combination thereof.

It is another object of the present invention to provide a new double action vacuum cleaner which may be easily and efficiently manufactured and marketed.

It is a further object of the present invention to provide a new double action vacuum cleaner which is of a durable and reliable construction.

An even further object of the present invention is to provide a new double action vacuum cleaner which is susceptible of a low cost of manufacture with regard to both materials and labor, and which accordingly is then susceptible of low prices of sale to the consuming public, thereby making such double action vacuum cleaner economically available to the buying public.

Still yet another object of the present invention is to provide a new double action vacuum cleaner which provides in the apparatuses and methods of the prior art some of the advantages thereof, while simultaneously overcoming some of the disadvantages normally associated therewith.

Still another object of the present invention is to provide a new double action vacuum cleaner for removing dirt from a recipient surface in an effective manner.

Even still another object of the present invention is to provide a new double action vacuum cleaner that includes a frame with a pair of wheels and a pair of brushes rotatably mounted to the frame. A motor assembly is included for rotating the brushes upon the actuation thereof. Also included is a handle portion having a pair of elongated bars each having an inboard end rotatably mounted to the frame and extending upwardly and rearwardly therefrom. Also provided is a vacuum assembly for suctioning dirt loosened by the brushes upon the actuation thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is perspective view of the present invention with the upper covering removed.

FIG. 4 is a bottom view of the present invention.

DESCRIPTION OF THE PREFERRED EMBODIMENT

Figure 1:
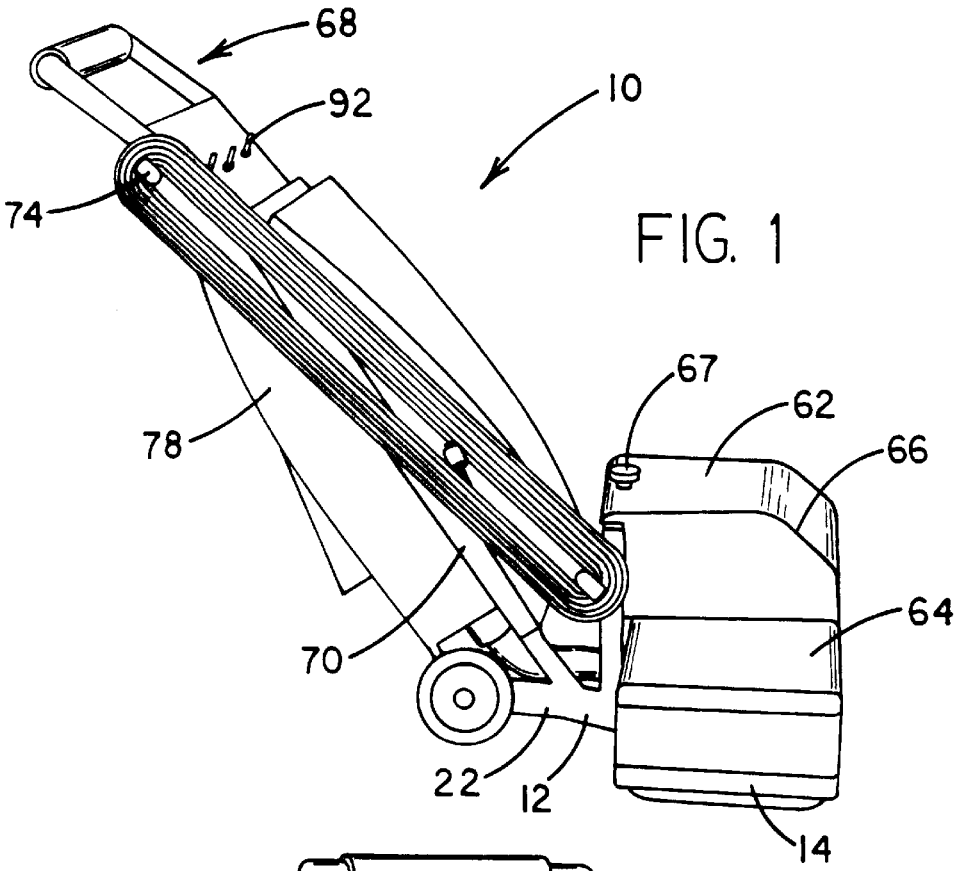
FIG. 1 is a side view of a new double action vacuum cleaner according to the present invention.

With reference now to the drawings, and in particular to FIGS. 1 through 6 thereof, a new double action vacuum cleaner embodying the principles and concepts of the present invention and generally designated by the reference numeral 10 will be described.

The present invention, designated as numeral 10, includes a frame 12 having a front extent 14 with a rectangular configuration and a width of about 25 inches. As shown in FIG. 3, the front extent of the frame is defined by a front bar 16, a rear bar 18 and a pair of side bars 20 mounted therebetween. The frame further includes a rear extent 22 including a first strip 24 mounted to the rear bar at a central extent thereof. Associated therewith is a second strip 26 mounted to the rear bar adjacent to an end thereof. As shown in FIG. 4, each of the strips of the rear extent extends rearwardly in coplanar relationship with respect to the front extent.

The frame of the vacuum cleaner further includes a pair of wheels 28 rotatably coupled to the ends of the strips of the rear extent of the frame. FIG. 4 shows a plurality of dual rollers 30 rotatably mounted along the rear bar of the front extent of the frame between the strips of the rear extent. The rollers preferably extend downwardly from the front extent less than a distance in which the wheels extend.

The frame further includes a bottom face 32 mounted to a lower peripheral edge of the front extent of the frame. As shown in FIG. 4, a pair of rectangular cut outs 34 are formed in the bottom face in parallel relationship with respect to each other. The frame further includes a top cover 36 having a front face, a rear face and a single side face defining an open side 38 and an open bottom with a bottom peripheral edge. Such bottom peripheral edge of the top cover is mounted along the bars of the front extent of the frame. See FIG. 3.

Next provided is a pair of brushes 40 each including a cylinder with a pulley 42 mounted on an end thereof. Each cylinder also has a plurality of strips of bristles coupled thereto and extending radially therefrom. As shown in FIG. 4, each strip of bristles has a length which is less than ⅓ a length of the brush and has an arcuate configuration. The brushes are each rotatably mounted between the side bars of the front extent of the frame with the bristles thereof extending from one of the cut outs of the bottom face of the frame. As shown in FIG. 3, the pulley of each brush is exposed by the open side of the top cover.

As best shown in FIG. 3, a motor assembly 44 is provided including a motor 46 mounted on the top cover. A rotor of the motor has a first end extending from a stator of the motor with a pulley 42 residing above that of a front one of the brushes. The pulley 42 is adapted for driving the pulley 48 via a first belt. A second end of the rotor is equipped with a first disk-shaped gear 50 mounted thereon. The motor assembly further includes a pair of vertically oriented stanchions 52 coupled to inboard ends of the strips of the rear extent of the frame and extending upwardly therefrom. A pair of horizontally oriented support members 54 are coupled between top ends of the stanchions and the motor.

Figure 6:
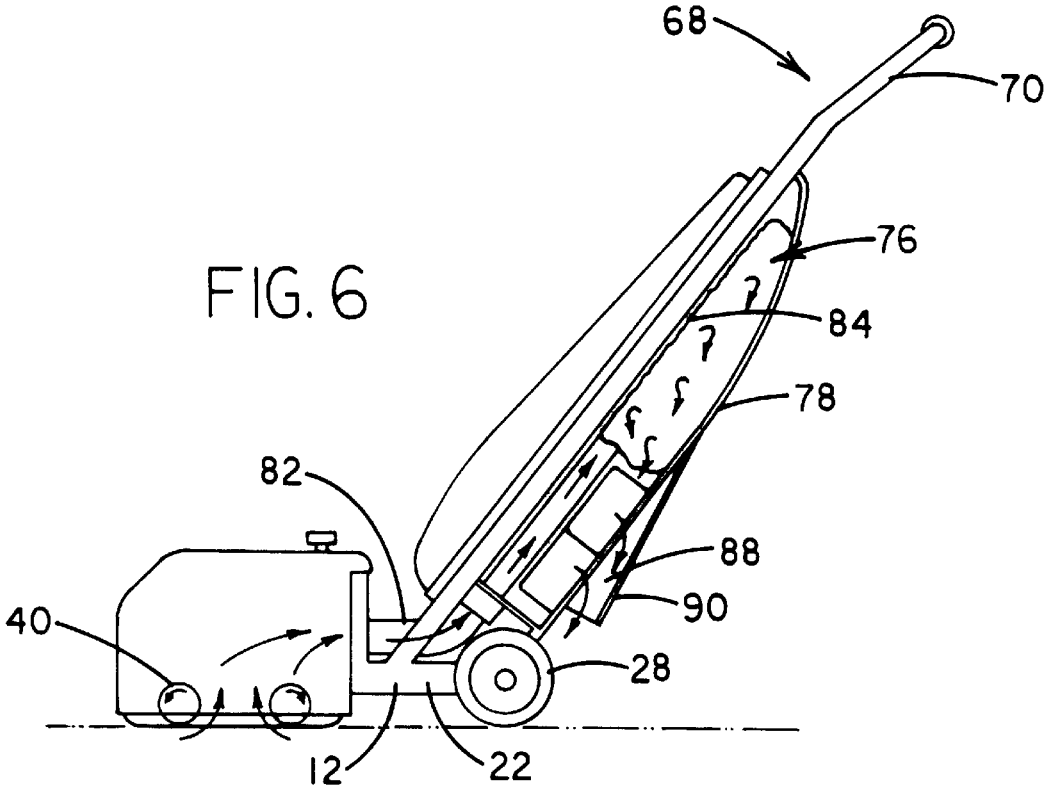
FIG. 6 is a side cross-sectional view of the present invention.

With reference still to FIG. 3, the motor assembly further includes an auxiliary axle 56 rotatably mounted between the support members. A first end of the auxiliary axle has a second disk-shaped gear 58 mounted thereon for engaging the first disk-shaped gear. A second end of the auxiliary axle has a pulley 60 in communication with that of a rear one of the brushes via a second belt. By this structure, the brushes are rotated in opposite directions upon the actuation of the motor. Ideally, the rear one of the brushes is rotated in a clockwise direction, as shown in FIG. 6.

Figure 2:
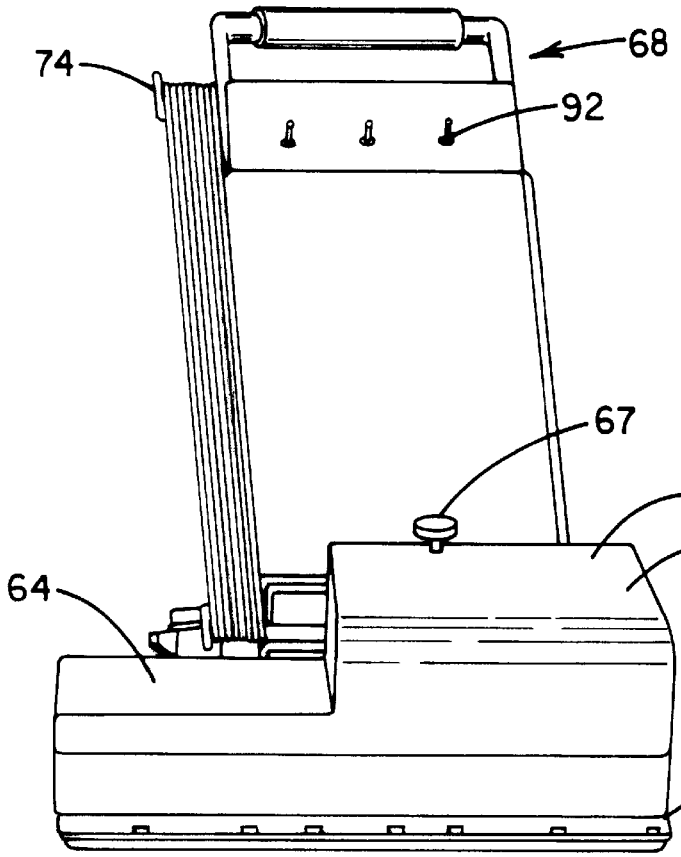
FIG. 2 is a front view of the present invention.

FIGS. 1 & 2 illustrate a rigid upper covering 62 having a first side extent 64 with a first height and a second side extent 66 with a second height twice the first height. In use, the upper covering is removably mounted over the front extent of the frame with the second side extent thereof covering the motor assembly. The second side extent of the upper covering has a handle 67 mounted thereon for allowing the removal of the upper covering from frame.

As shown in FIG. 3, a handle portion 68 includes a pair of elongated bars 70 each having an inboard end rotatably mounted to a central extent of one of the strips of the rear extent of the frame. The elongated bars of the handle portion extend upwardly and rearwardly from the frame. A handle bar is mounted between outboard ends of the elongated bars. Further, a pair of L-shaped brackets 74 are coupled to ends of one of the elongated bars for allowing a power cord to be wrapped thereon.

Figure 5:
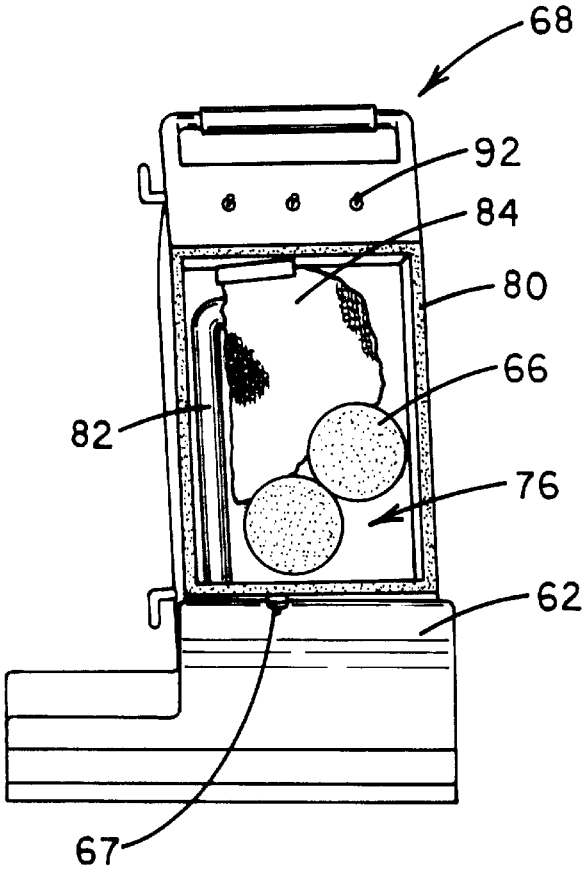
FIG. 5 is a front view of the present invention with the top face of the casing of the vacuum assembly removed.

Also included is a vacuum assembly 76 including a casing 78 having a rigid bottom face and a pair of side faces extending upwardly from side edges of the bottom face. Such side faces of the casing are coupled along the elongated bars of the handle portion. The casing of the vacuum assembly further includes a removable top face mounted between the elongated bars of the handle portion for defining a closed interior space. As shown in FIG. 5, a seal 80 is preferably situated between the top face of the casing the remaining portions thereof.

FIGS. 3 & 5 shows a flexible vacuum tube 82 of the vacuum assembly with a first end in communication with an interior space defined by the top cover of the frame. A second end of the vacuum tube extends within the interior space of the casing with an inflatable air permeable bag 84 coupled thereto. Mounted to the bottom face of the casing is a pair of vacuum motors 86 each with a filtered inlet situated within the interior space of the vacuum casing. An outlet of each vacuum motor extends through a vent 88 formed in the bottom face of the casing. The vent preferably includes a downwardly extending, tapering chute 90. In operation, the vacuum motors suction air from within the top cover and excrete the same from the vacuum casing upon the actuation thereof. This effects the collection of debris within the bag.

Finally, a plurality of controls 92 are positioned on an upper extent of the top face of the casing of the vacuum assembly. Such controls which preferably take the form of toggle switches are connected between the vacuum motors and the motor of the motor assembly for selectively actuating the same in an independent manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A double action vacuum cleaner comprising, in combination:

a frame including a front extent with a rectangular configuration defined by a front bar, a rear bar and a pair of side bars mounted therebetween, the frame further including a rear extent including a first strip mounted to the rear bar at a central extent thereof and a second strip mounted to the rear bar adjacent to an end thereof with each of the strips of the rear extent extending rearwardly in coplanar relationship with respect to the front extent, the frame further including a pair of wheels rotatably coupled to ends of the strips of the rear extent of the frame and a plurality of dual rollers rotatably mounted along the rear bar of the front extend of the frame between the strips of the rear extent and extending downwardly from the front extent less than a distance in which the wheels extend, the frame further including a bottom face mounted to a lower peripheral edge of the front extent of the frame with a pair of rectangular cut outs formed therein in parallel relationship and a top cover including a front face, a rear face and a single side face defining an open side and an open bottom with a bottom peripheral edge mounted along the bars of the front extent of the frame;

a pair of brushes each including a cylinder with a pulley mounted on an end thereof and a plurality of strips of bristles coupled to the cylinders and extending radially therefrom, wherein each strip of bristles has a length which is less than ⅓ a length of the cylinder and has an arcuate configuration, the brushes each rotatably mounted between the side bars of the front extent of the frame with the bristles thereof extending from one of the cut outs of the bottom face of the frame and the pulley exposed by the open side of the top cover;

a motor assembly including a motor mounted on the top cover with a rotor having a first end extending from a stator of the motor with a pulley residing above that of a front one of the brushes for engaging the same via a first belt and a second end with a first disk-shaped gear mounted thereon, the motor assembly including a pair of vertically oriented stanchions coupled to inboard ends of the strips of the rear extent of the frame and extending upwardly therefrom and a pair of horizontally oriented support members coupled between top ends of the stanchions and the motor, the motor assembly further including an auxiliary axle rotatably mounted between the support members with a first end having a second disk-shaped gear mounted thereon for engaging the first disk-shaped gear and a second end with a pulley in communication with that of a rear one of the brushes via a second belt, wherein the brushes are rotated in opposite directions upon the actuation of the motor;

a rigid upper covering with a first side extent with a first height and a second side extent with a second height twice the first height, the upper covering being removably mounted over the front extent of the frame with the second side extent thereof covering the motor assembly and having a handle mounted thereon for allowing the removal of the upper covering from frame;

a handle portion including a pair of elongated bars each having an inboard end rotatably mounted to a central extent of one of the strips of the rear extent of the frame and extending upwardly and rearwardly therefrom, a handle bar mounted between outboard ends of the elongated bars, and a pair of L-shaped brackets coupled to ends of one of the elongated bars for allowing a power cord to be wrapped thereon;

a vacuum assembly including a casing having a rigid bottom face and a pair of side faces extending from side edges of the bottom face and coupled along the elongated bars of the handle portion, the vacuum casing further including a removable top face mounted between the elongated bars of the handle portion for defining a closed interior space, the vacuum assembly further including a flexible vacuum tube with a first end in communication with an interior space defined by the top cover of the frame and a second end extending within the interior space of the casing, an inflatable air permeable bag mounted on the second end of the vacuum tube, and a pair of vacuum motors each mounted to the bottom face of the casing with a filtered inlet situated within the interior space of the vacuum casing and an outlet extending through a vent formed in the bottom face of the casing, wherein the vacuum motors suction air from within the top cover and excrete the same from the vacuum casing upon the actuation thereof; and a plurality of controls mounted on the top face of the casing of the vacuum assembly and connected between the vacuum motors and the motor of the motor assembly for selectively actuating the same in an independent manner.

2. A double action vacuum cleaner comprising:

a frame with a pair of wheels mounted thereon for supporting the frame above a surface to be vacuumed;

a pair of brushes rotatably mounted to the frame;

a motor assembly for rotating the brushes upon the actuation thereof;

a handle portion having an inboard end rotatably mounted to the frame and extending upwardly and rearwardly therefrom;

a vacuum assembly for suctioning dirt loosened by the brushes upon the actuation thereof; and a plurality of rollers mounted along a rear of the frame, the plurality of rollers being mounted between the pair of wheels and the pair of brushes for supporting the brushes above the surface to be vacuumed.

3. The double action vacuum cleaner as set forth in claim 2 wherein the handle portion includes a pair of elongated bars mounted to a central extent of the frame.

4. The double action vacuum cleaner as set forth in claim 3 wherein the vacuum assembly is positioned within a rigid casing mounted between the elongated bars of the handle.

5. The double action vacuum cleaner as set forth in claim 2 wherein the motor assembly is adapted to rotate the brushes in opposite directions when the motor assembly is actuated.

6. The double action vacuum cleaner as set forth in claim 2 wherein a top cover is positioned adjacent to the brushes, and a removable upper covering is positioned adjacent to the motor assembly and the brushes.

7. The double action vacuum cleaner as set forth in claim 2 wherein the frame includes a front extent defined by a front bar, a rear bar and a pair of side bars mounted between the front and rear bars.

8. The double action vacuum cleaner as set forth in claim 7 wherein the frame includes a rear extent including a first strip mounted to the rear bar at a central extent thereof and a second strip mounted to the rear bar adjacent to an end thereof with each of the strips of the rear extent extending rearwardly in coplanar relationship with respect to the front extent.

9. The double action vacuum cleaner as set forth in claim 2 wherein each of the pair of brushes includes a cylinder with a pulley mounted on an end of the cylinder, and a plurality of bristles coupled to the cylinders and extending radially therefrom.

10. The double action vacuum cleaner as set forth in claim 2 wherein the vacuum assembly includes a casing having a rigid bottom face and a pair of side faces extending from side edges of the bottom face and coupled to elongated bars of the handle portion, the vacuum casing further including a removable top face mounted between the elongated bars of the handle portion for defining a closed interior space, the vacuum assembly further including a flexible vacuum tube with a first end in communication with an interior space defined by a top cover of the frame and a second end extending in the interior space of the casing.

11. The double action vacuum cleaner as set forth in claim 10 additionally comprising an inflatable air permeable bag mounted on the second end of the vacuum tube, and a pair of vacuum motors each mounted to the bottom face of the casing with a filtered inlet situated in the interior space of the vacuum casing and an outlet extending through a vent formed in the bottom face of the casing, wherein the vacuum motors suction air from inside the top cover and outlet the suctioned air from the vacuum casing upon the actuation of the vacuum assembly.

12. A double action vacuum cleaner comprising:

a frame including a front extent with a front bar, a rear bar and a pair of side bars mounted therebetween, the frame further including a rear extent including a first strip mounted to the rear bar at a central extent thereof and a second strip mounted to the rear bar adjacent to an end thereof with each of the strips of the rear extent extending rearwardly, the frame further including a pair of wheels rotatably coupled to ends of the strips of the rear extent of the frame and a plurality of rollers rotatably mounted along the rear bar of the front extent of the frame between the strips of the rear extent, the plurality of rollers extending downwardly from the front extent, the frame further including a bottom face mounted to a periphery of the front extent of the frame with a pair of cut outs formed therein, and a top cover including a front face, a rear face and a side face defining an open side and an open bottom with a bottom peripheral edge mounted along the bars of the front extent of the frame;

a pair of brushes each including a cylinder with a pulley mounted on an end thereof and a plurality of strips of bristles coupled to the cylinders and extending radially therefrom, the brushes each rotatably mounted between the side bars of the front extent of the frame with the bristles thereof extending from one of the cut outs of the bottom face of the frame;

a motor assembly including a motor operatively engaged to the brushes such that the brushes are rotated in opposite directions upon the actuation of the motor;

an upper covering removably mounted over the front extent of the frame and covering the motor assembly;

a handle portion including a pair of elongated bars each having an inboard end rotatably mounted to a central extent of one of the strips of the rear extent of the frame and extending upwardly and rearwardly therefrom, a handle bar mounted between outboard ends of the elongated bars;

a vacuum assembly including a casing having a bottom face and a pair of side faces extending from side edges of the bottom face and coupled to the elongated bars of the handle portion, the casing further including a removable top face mounted between the elongated bars of the handle portion for defining a closed interior space, the vacuum assembly further including a vacuum tube with a first end in communication with an interior space defined by the top cover of the frame and a second end extending in the interior space of the casing, an inflatable air permeable bag mounted on the second end of the vacuum tube, and a vacuum motor mounted to the casing with a filtered inlet situated in the interior space of the vacuum casing and an outlet extending through a vent in the casing, wherein the vacuum motor suctions air from in the top cover and excretes the air from the vacuum casing upon the actuation of the vacuum motor; and a plurality of controls mounted on the casing of the vacuum assembly and connected between the vacuum motor and the motor of the motor assembly for selectively actuating the motors in an independent manner.

* * * * *